US005297636A

United States Patent [19]

North

[11] Patent Number: 5,297,636

[45] Date of Patent: Mar. 29, 1994

[54] FIRE EXTINGUISHING SYSTEM FOR COOKSTOVES AND RANGES

[75] Inventor: Grady North, Grapevine, Tex.

[73] Assignee: Twenty First Century, Irving, Tex.

[21] Appl. No.: 860,726

[22] Filed: Mar. 31, 1992

Related U.S. Application Data

[63] Continuation-in-part of Ser. No. 634,357, Dec. 31, 1990, Pat. No. 5,127,479.

[51] Int. Cl.[5] ..... A62C 3/00

[52] U.S. Cl. ..... 169/65

[58] Field of Search ..... 169/65, 23; 251/63.5, 251/63.6, 73; 137/456, 461, 463

[56] References Cited

U.S. PATENT DOCUMENTS

| | | | |
|---|---|---|---|
| 4,773,485 | 9/1988 | Silverman | 169/65 |
| 4,979,572 | 12/1990 | Mikulec | 169/65 |
| 5,048,791 | 9/1991 | Ellison et al. | 251/73 |
| 5,127,479 | 7/1992 | Stehling et al. | 169/65 |

*Primary Examiner*—David M. Mitchell
*Assistant Examiner*—Gary C. Hoge
*Attorney, Agent, or Firm*—Millen, White, Zelano, & Branigan

[57] ABSTRACT

A fire extinguishing system for a residential cookstove or range includes a fire extinguisher mounted above a hood in a cabinet positioned over the cookstove or range. The fire extinguisher is connected by flexible hoses and/or adjustable pipes to a pair of nozzles within the hood to dispense fire suppressant over the cookstove or range. The fire extinguisher includes an operator normally biased to the operable position, but held in the inoperable position by a cable system having a plurality of fusible or reusable, heat-activated links distributed therein. The cable system is held in tension adjacent the inner periphery of the hood and includes a section of chain to facilitate installation. Upon the occurrence of a fire, at least one of the links separates, releasing the cable system and allowing the operator to move to the operating position whereby the fire extinguisher releases the fire suppressant. Upon the fire extinguisher's releasing the fire suppressant, a hose connected to a pneumatically operated valve in the gas supply line is pressurized. When the hose is pressurized, the valve closes, shutting off the supply of gas to the stove. The valve includes a reset button to restart the flow of gas once the system is reactivated.

3 Claims, 5 Drawing Sheets

FIRE EXTINGUISHING SYSTEM FOR COOKSTOVES AND RANGES

CROSS-REFERENCE TO RELATED APPLICATION

This application is a continuation in part of U.S. Pat. application Ser. No. 07/634,357, filed Dec. 31, 1990 now U.S. Pat. No. 5,127,479.

BACKGROUND OF THE INVENTION

This invention relates to an automatically operated fire extinguishing system usable for both electrical and gas residential cookstoves or ranges. More particularly, the invention concerns such a system which is mounted in a hood positioned over a residential stove or range.

Until relatively recently, automatic fire extinguishing systems for use with residential cookstoves and ranges have generally been concerned with extinguishing fires caused by fat burning in a commercial grease pot or kettle. Generally, the systems were solely concerned with extinguishing the fire. No provision was made for turning off electrical and gas burners of the stove. Consequently, the fire extinguishing system would extinguish the lighted burners of a gas stove while allowing the gas to continue flowing. This created the very hazardous condition of allowing unburned gas to flow from the burners, resulting in a situation in which a residence could fill with gas to dangerous levels and then explode. Or perhaps, on the other hand, the residents were exposed to the hazard of being asphyxiated by gas fumes. If the system is used with an electric stove, the burners could reignite spilled grease and fat once the fire extinguishing foam had dissipated. Moreover, these arrangements had no provision for sounding an alarm or deenergizing associated exhaust equipment.

U.S. Pat. No. 3,653,443 recognized the aforementioned difficulties with the prior art and provided a system for shutting off the stove, operating an alarm and deenergize exhaust fans. To the knowledge of the instant inventor, the concepts set forth in U.S. Pat. No. 3,653,443 have never been commercialized. The particular arrangement set forth in this patent has apparently not been commercialized because of the expense and difficulty in combining the concept of this patent with existing residential hood configurations. In other words, the particular structure disclosed in this patent is not readily retrofittable on existing residential stoves and stove hoods.

The prior art discloses numerous arrangements for automatically extinguishing stove fires. U.S. Pat. No. 4,256,181 discloses a fire extinguisher in combination with a hood. However, this patent requires a tube for conducting heat from the stove to a mechanism for operating the fire extinguisher. The operating mechanism includes a flammable fuel which generates heat in a hood above the stove making the operating system itself a fire hazard. The foam from the extinguisher is dispensed on the stove.

Other patents, such as U.S. Pat. Nos. 4,580,638; 3,584,688; 3,448,808; and 3,824,374, each disclose arrangements of cables and fusible links. However, these arrangements are not configured in a fashion which is readily adaptable to retrofitting in existing residential stove hoods or existing residential stove configurations. These arrangements are suitable for commercial kitchens rather than residential kitchens.

In order for an automatic fire extinguishing system to be widely used in residential kitchens, it is necessary for the system to be configured so that any home owner or resident with minimal mechanical skills can install the system. Ordinarily, household fire warning equipment designed to be installed by other than a qualified electrician cannot be powered from a source having a voltage in excess of 30 volts. Accordingly, in order to avoid the need for a qualified electrician, stove fire extinguishing systems must operate on less than 30 volts. None of the systems currently available meet this requirement, since they all require house line current.

If a range utilizes gas as a fuel and electric power to the house is interrupted, the systems currently available will not function properly during a power outage, since there is no power available to control the flow of gas to the gas burners. Accordingly, a very dangerous situation arises if there is a power outage during which a stove fire is extinguished, but gas continues to flow through the burners. The gas in and of itself can asphyxiate people in the house or can accumulate and explode when the electricity comes back on and generates a miscellaneous spark at a location in the house where gas has accumulated. The systems of the prior art do not protect residences in this particular situation.

This is not a problem unique to residential systems. As is set forth in the background discussion of U.S. Pat. No. 5,048,791, which the instant applicant's invention precedes, industrial systems have similar problems. According to U.S. Pat. No. 5,048,791, with industrial processes that involve hazardous or combustible substances, there is always a risk that a malfunction may result in damage of injury. To minimize the damage caused by such a malfunction, it is desirable to shut off the flow of hazardous substances as soon as the emergency is detected. This is particularly true in industrial operations that employ combustible fuels such as natural gas for heating in a furnace or oven. It is desirable to shut off the flow of combustible gas as soon as the fire condition is sensed.

Industrial furnaces and ovens are often equipped with automatic fire detection and extinguishing systems. Such systems are designed to sense a fire or an overheated condition and to spray $CO_2$, dry chemical, foam or another type of fire extinguishing agent on the fire. When the fire extinguishing system is triggered, it is almost always desirable to shut off the flow of fuel to the furnace or oven. Of course, when the emergency condition is corrected, it is necessary to reinstitute the flow of gas to that the process may be restarted.

Various types of systems have been devised which use conventional valves to shut off the flow of combustible material to a furnace or oven when a fire occurs. Such systems involve components such as sensors, relays, solenoids, transformers, and other items which may malfunction. A malfunction could result in the fuel continuing to be delivered even after the fire extinguishing system is tripped. This may defeat the fire extinguishing system.

Thus, there exists a need for a device which will shut off the flow of combustible fuel to an industrial furnace or oven or other type of heating device when a fire extinguishing system is tripped. There further exists a need for a device that is less costly and has greater reliability than prior devices and systems.

In view of the aforementioned deficiencies in previously existing fire-suppressing systems when applied to residential cookstoves, the assignee of the instant invention developed the fire-suppressing systems disclosed in U.S. Pat. Nos. 4,773,485 and 4,834,188. The systems disclosed in these patents have achieved acceptance in the field and have been installed in combination with hundreds of cookstoves. However, there is a need to configure the systems, as basically disclosed in these two patents, in such a way to further facilitate the ease with which householders can readily install the systems. Moreover, configuring the system for relatively easy installation allows skilled installers to proceed more rapidly and less expensively.

SUMMARY OF THE INVENTION

It is an object of the instant invention to provide a new and improved system for extinguishing fires on residential cookstoves and ranges wherein the system is automatic and is readily retrofittable to existing residential stove hoods.

Upon further study of the specification and appended claims, further objects and advantages of this invention will become apparent to those skilled in the art.

In view of the aforementioned object, and other objects, the instant invention contemplates a valve posited between a gas inlet line and a gas burner, the valve being connected to a discharge line of a fire extinguisher and being closed upon discharge of the fire extinguisher.

In a more specific aspect of the invention, the burner is the burner of a cooking stove, and the fire extinguisher is operated by a detector which detects grease fires occurring on the stove.

In a still more specific aspect of the invention, the cooking stove is a residential cooking stove.

DETAILED DESCRIPTION

Figure 1:
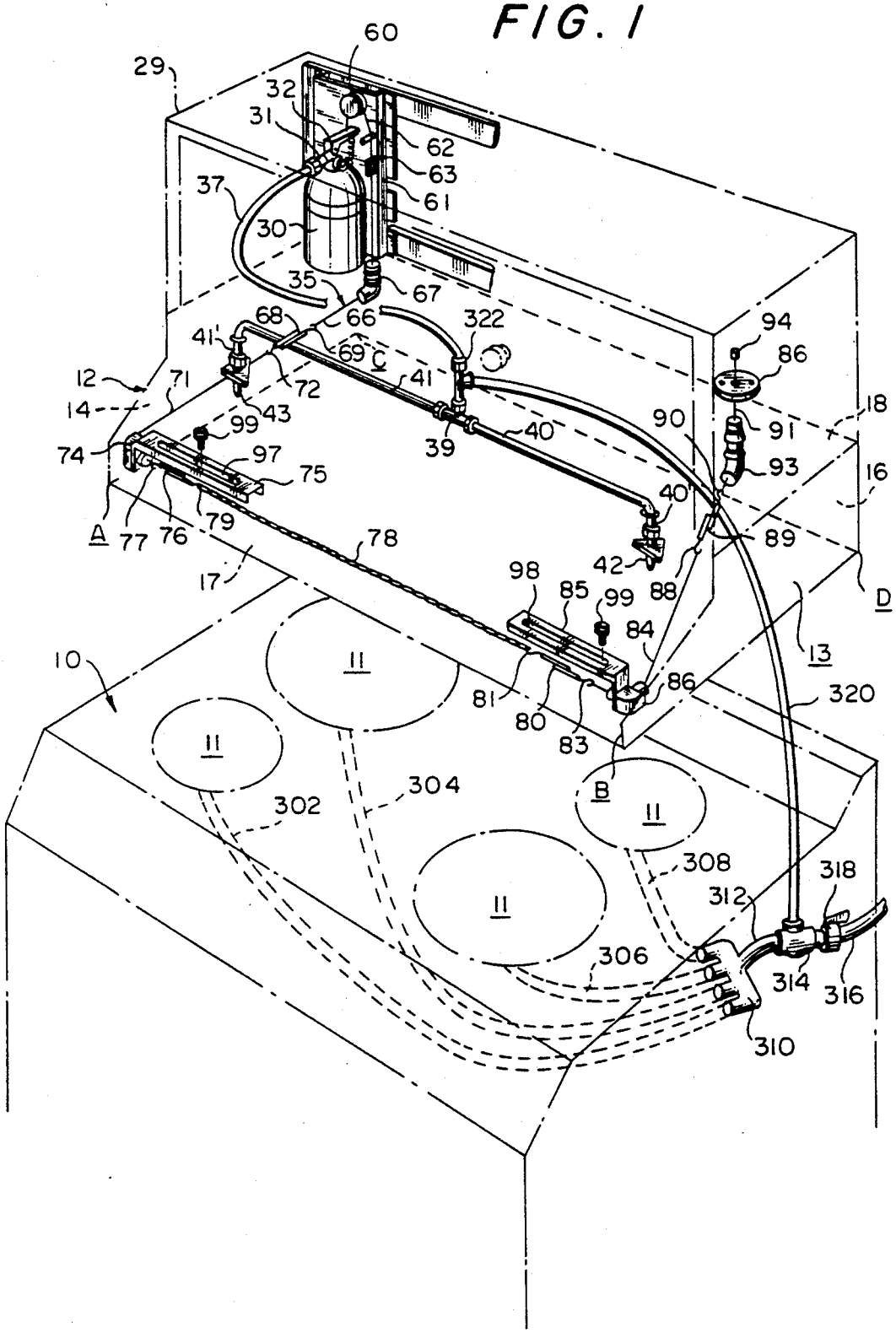
FIG. 1 is a perspective view of a fire extinguishing system in combination with a residential stove, hood, and adjacent cabinet, and further including a pneumatically operated gas line shut-off valve connected in accordance with the principles of the instant invention.

Referring now to FIG. 1 there is shown a residential stove or range, designated generally by the numeral 10, which includes a plurality of gas burners 11. Positioned over the stove or range 10 is a conventional hood, designated generally by the numeral 12. The hood 12 has a pair of sidewalls 13 and 14, a rear wall 16, a front wall 17 and a top wall 18 and has corresponding first and second front corners A and B and first and second rear corners C and D. The hood 12 has an opening (not shown), preferably through the top surface 18 thereof which is attached to a duct (not shown) having an exhaust fan (not shown) therein for forcibly evacuating fumes and vapor which collect in the hood while cooking on the residential stove 10 (see U.S. Pat. No. 4,834,188, incorporated herein by reference).

In accordance with the principles of the instant invention, a fire extinguisher, designated generally by the numeral 30, is positioned adjacent to, and preferably over the hood 12 in a cabinet 29, schematically illustrated by a broken line. The fire extinguisher 30 is a conventional extinguisher and may dispense either a liquid or dry fire suppressant material. In accordance with the preferred embodiment of the invention, the extinguishing agent is a dry chemical agent. For residential use, the chemical agent is 4.5 pounds by weight and made according to a formulation that is designed for rapid flame knockdown and securement of cooking grease-related fires. The agent discharge time is at least 15–30 seconds to insure fire extinguishment and eliminate flashback. The discharge rate is gentle enough to avoid splattering of burning grease.

Figure 2:
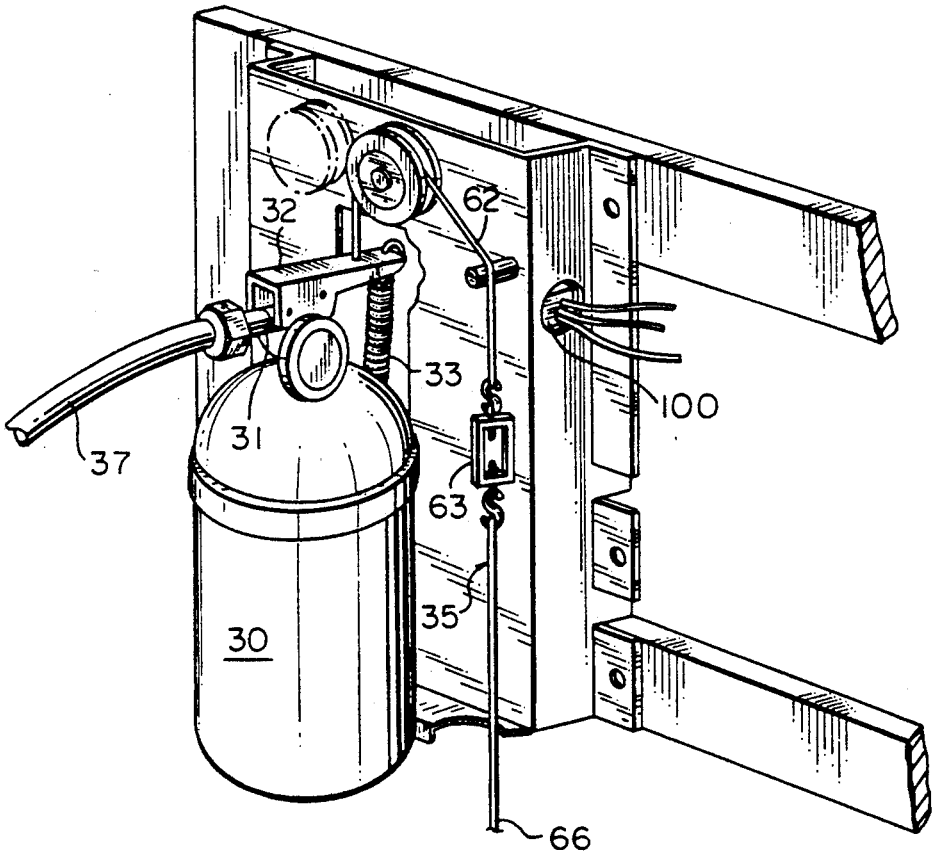
FIG. 2 is a perspective view of a mounting bracket for a fire extinguisher used in the combination of Figure 1.

As is best seen in FIG. 2, the fire extinguisher 30 has an outlet 31 through which the fire suppressant material flows under pressure upon moving operating lever 32 downwardly. The operating lever 32 is attached to a coil spring 33 which is under tension. The coil spring 33 biases the operating lever 32 downwardly so as to eject fire suppressant material through the outlet 31. As will be explained more fully hereinafter, the operating lever 32 is held in a first, non-operating position by tension on a cable assembly, designated generally by numeral 35. Upon release of the tension on the cable assembly 35, the operating lever 32 moves to a second position as the spring 33 contracts and the fire extinguishing material moves out through the nozzle 31, through a flexible hose 37 to a distribution assembly T-joint 39 (FIG. 1).

In accordance with the principles of the instant invention and as is seen in FIG. 1, the flexible hose 37 allows the installer to maneuver around obstacles in the cabinet 29. The T-joint 39 is connected to a pair of horizontal pipes 40 and 41 extending in the cabinet 29 in directions toward the sidewalls of the cabinet. The end sections 40' and 41' of each of the pipes 40 and 41 are bent at approximately 90° with respect to the horizontal sections 40' and 41' of the pipes. The end sections through which the fire suppressant nozzles are attached expands and covers the top of the stove or range 10, putting out any fire thereon.

Figure 3A:
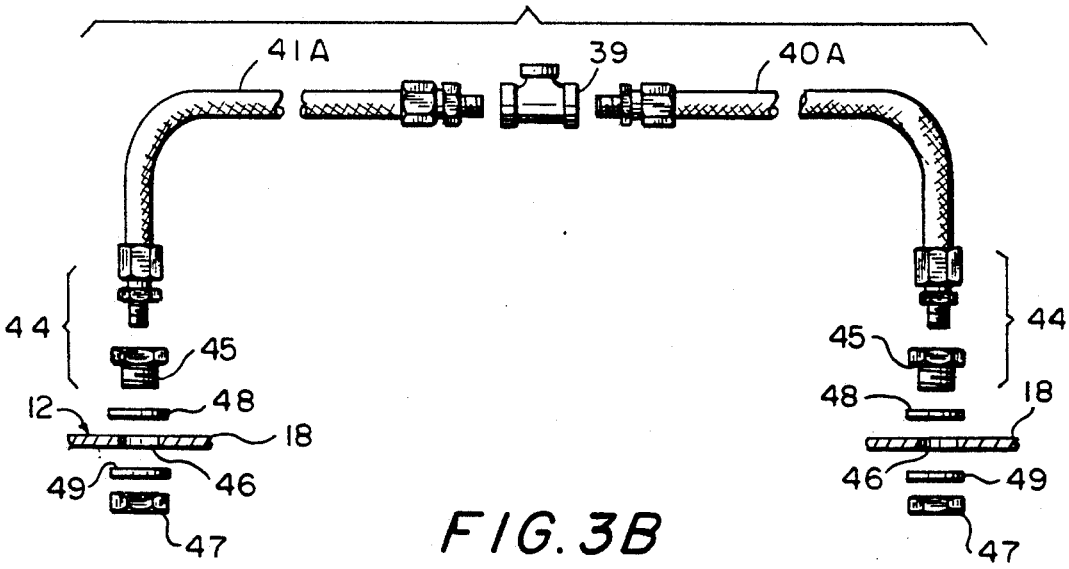
FIG. 3A and 3B are side views of a pair of flexible hoses supplied as an installation kit with the fire extinguishing system of the instant invention.
Figure 3B:
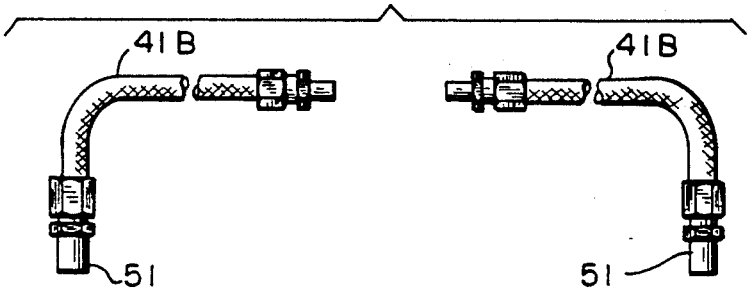

In accordance with the improvements of the instant invention, the fire extinguishing system is distributed as a kit with a selection of piping systems for the pipes 40 and 41. As is seen in FIGS. 3A and 3B, the pipes 40 and 41 are configured as flexible hose pairs 40A–41A and 40B–41B. The flexible hose pairs have lengths in the range of 10–30'+ in overall length and are factory preassembled. The flexible hoses 40A–41A and 40B–41B allow the installer to route the hoses around obstacles in the cabinet 29, greatly facilitating installation by skilled installers, while making the system easier to install by inexperienced installers or householders.

With the non-rigid hose assemblies 40A–41A and 40B–41B, it is necessary that the hose lengths 40 and 41 be equal so that the T-joint 39 is centered between the nozzles 43.

When access to both sides of the top surface 18 of the range hood 12 is available, it is suggested that the arrangement of FIG. 3A be used wherein quick seal adaptors, designated generally by the numerals 44, are provided. Each quick seal adaptor 44 includes an internally and externally threaded sleeve 45 retained in a hole 46 through top wall 18 of the hood 12 by a nut 47. A pair of washers 48 and 49 are positioned on the sleeve 45 on opposite sides of the top wall 18 of the hood 12. The hoses 40A and 41A each have a threaded end fitting 50, which screws into and projects beyond the sleeve 45 a sufficient distance to allow attachment of the nozzles 42 and 43, respectively.

The hose pair 40B and 41B of FIG. 3B relies on ½, schedule 40 black iron, pipe nozzles and/or couplings 51. In any case, the maximum overall length of the flexible hoses, including nipples or couplings must not exceed 30".

Figure 4:
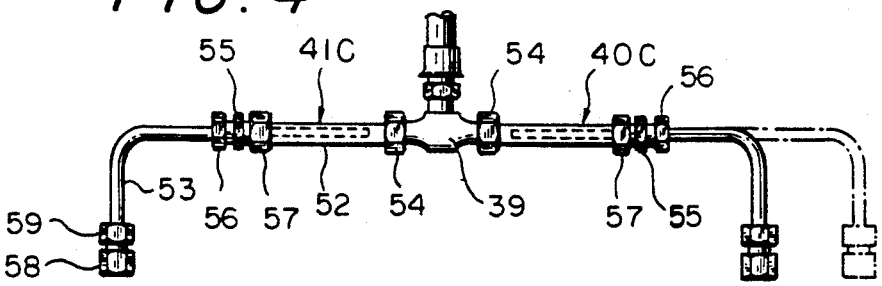
FIG. 4 is a side view of an adjustable length, steel piping kit used with the fire extinguishing system of the instant invention.
Figure 5:
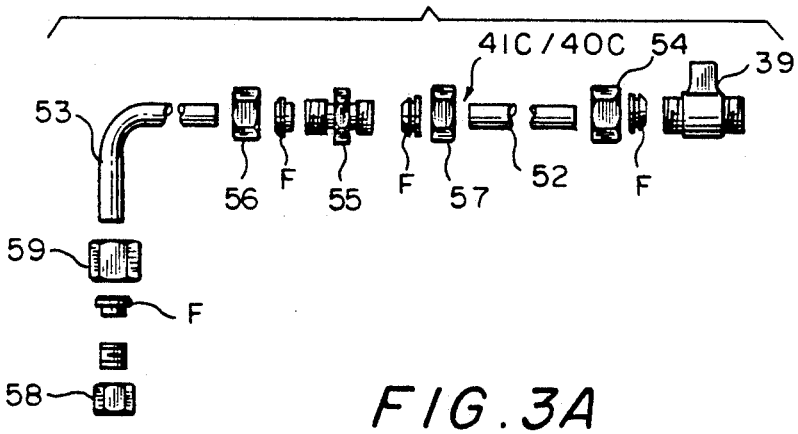
FIG. 5 is an exploded view of one of the adjustable length pipes of FIG. 4.

Referring now to FIGS. 4 and 5, there is shown another piping kit arrangement wherein the pipes 40C and 41C are each configured of a straight stainless steel section 52 and an L-shaped stainless steel section 53 telescopically received in the straight section. The straight section 52 is coupled to the T-joint 39 by a nut 54 and compression ferrules squeezed thereagainst, while the L-shaped section 53 is coupled to the straight section, with a union 55 attached via nuts 56 and 57 threaded thereon. Again, compression ferrules f are squeezed against the pipe sections 52 and 53 by the nuts 56 and 57 to fix the pipe section with respect to one another. The pipe sections 40C and 41C of FIGS. 4 and 5 have a minimum length from the center of the tee 39 of 8" and telescope to a maximum length of 13". It is preferable that the downward leg of the L-shaped section have a length in the range of 3–5", with a preferable length of about 3∝'. In a commercial embodiment, the straight section 52 has an inner diameter of a little less than ½, and the L-shaped section 53 has an outer diameter of ⅜ so that the sections readily telescope. At the free ends of the L-shaped sections 53, either a male or female fitting 58 is secured by compression nuts 59 and internal ferrules f for attaching the nozzles 42 and 43. Again, it is preferably that the pipes 40C and 41C be of equal length when installed.

Referring again to FIGS. 1 and 2, the cable assembly 35, which holds the operating handle 32 in the first position against the bias of spring 33, is looped over a first pulley 60 journalled on a mounting bracket 61 which supports the fire extinguisher 30. The bracket 61 is rigidly attached to a side or rear wall of the cabinet 29. As is seen in FIG. 2, the cable 35 has a first section 62 which is attached to a turnbuckle 63 that allows adjustment of the cable. A second section of the cable 66 is attached to the other end of the turnbuckle and is trained around a pulley 67 that is secured to the underside of the top wall 18 of the hood 12 which has a hole therethrough through which the second section of the cable passes. The second section of the cable 66 exits from the pulley 67 at a right angle to the direction in which it entered the pulley and extends a distance horizontally within the hood 12 generally parallel to the side 14 of the hood. A first fusible or reusable link 68 is attached to the second length of cable 66 by an S-hook 69. The other end of the fusible link 68 is attached to a third length of cable 71 by a second S-hook 72. The third length of cable 71 is trained around a second pulley 74 mounted on an L-shaped bracket 75 in the first front corner A of the hood 12 and emerges adjacent the front wall 17 of the hood where it is connected to a second fusible link 76 by an S-hook 77.

In accordance with the principles of the instant invention, the second fusible or reusable link 76 is connected to a length of chain 78 by an S-hook 79 which extends behind the front wall 17 a distance to a fourth heat fusible link 80 to which the length of chain is connected by an S-hook 81. The length of the chain 78 is readily determined by selecting the links within the chain which are engaged by S-hooks 79 and 81. Once the entire cable assembly 35 is strung through the pulleys, the assembly is rendered substantially taut by hooking of the end of the chain 78 in one of the S-hooks 79 or 81; pulling the chain and other S-hook toward one another and, when the chain is taut, hooking with the free S-hook the chain link closest to the free S-hook. A fourth length of cable 84 is attached by an S-hook 83 to the fusible or reusable link 80 and extends around a third pulley 86 mounted at corner B on L-shaped bracket 85 so as to extend along behind the sidewall 13 of the hood 12. The fourth cable 84 is connected by S-hook 88 to a fourth fusible or reusable length 89 and by S-hook 90 to a fifth length of cable 91. The fifth length of cable 91 is trained around a fourth pulley 93 and emerges through the top wall 18 of the hood 12 where it is secured to a stop 94. The stop 94 prevents the fifth cable 71 from sliding through a hole 95 in a flange 86 which is positioned on the bottom of the cabinet 29. The cable assembly 35 and fusible links are not enclosed in conduits or housings but are exposed. However, the cable and links are ordinarily concealed from view because they are within the hood structure.

The L-shaped brackets 75 and 85 have slots 97 and 98 therein, which receive screws 99 to adjustably secure the brackets to the wall of the hood 12. In the illustrated embodiment, the brackets 75 and 85 are attached by screws or bolts 99 to the inner surface of the top wall of the hood 12; however, since the pulley housings 74 and 86 are rotatable with respect to the brackets, the brackets can also be mounted on the inner surface of front wall 17 of the hood.

The fire extinguishing system in accordance with the principles of the instant invention may be installed by the average homeowner using existing tools. First, the fire extinguisher 30 is placed above the hood 12 in the cabinet 29. The flexible pipe 37 for carrying fire suppressant from the fire extinguisher 30 is then connected in the cabinet to the T-joint 39, and the horizontally extending pipes 40 and 41 selected from FIGS. 3 and 5 are screwed into the tee joint. Holes are made through the bottom of the cabinet 29 and the top wall 18 of the hood 12 and the downwardly extending ends of the pipes 40 and 41 extended therethrough. After the pipes 41 and 41 are secured within the holes through the bottom of the cabinet 29 and top of the hood 12, nozzles 42 and 43 are screwed into the ends of the pipes.

After the piping is installed, the cable assembly 35 with the chain 78 is strung through the system by sequentially attaching the fusible or reusable links 68, 76, 80, and 89 thereto with the various S-hooks. The portion of the fourth cable section 91 which extends through plate 95 is then secured by fixing the stop 94 to the end of the fourth cable section 91. The turnbuckle 63 can then be shortened to take up any slack in the cable assembly 35 and to tension the cable assembly. Spring 33 is then anchored behind the bracket 39 at one end and stretched to reach and overlie the handle 32 so as to bias the handle 32 in a downward direction toward the second position. Tension in the cable assembly 35 retains the handle 32 in the first position. The fire extinguishing system is now set to automatically operate upon the occurrence of a fire on the stove 10.

When there is a fire on the stove, the fire will melt the solder or other material fusing the halves of at least one of the links 48, 56, 60 and 69 together. As soon as one of the links separates due to heat from the fire, the cable 35 will no longer be tensioned and spring 33 will move the handle 32 from its first position to its second position, causing the extinguisher 30 to release the fire suppressant chemicals therein. The extinguisher 30 will continue to operate until the fire suppressant chemical is exhausted.

If there is no one present when the fire occurs, to turn off the gas burners 11 on the stove 10, the dangerous condition which caused the fire in the first place can resume without there being any further provision for putting out a subsequent fire. Since discharging the fire extinguisher 30 does not automatically turn off the source of heat which started the fire initially, the burners 11, if they are electrical burners, will continue to generate heat. After a while, the grease which remains on the stove 10 may again reignite. Since the fire extinguishing system is a one-shot arrangement, the subsequent fire cannot be extinguished by the system. If the burners 11 are gas burners, the fire suppressant will extinguish the burners; however, the gas for energizing the burners will continue to enter the stove and pour into the room without burning. This accumulation of gas could result in a subsequent explosion or could asphyxiate people in the residence where the stove 10 is located.

In order to prevent the occurrence of these situations, a microswitch 100 detects when the handle of the extinguisher is moved down by spring 33, causing the fire extinguisher 30 to discharge. Microswitch 100 is connected by leads to the circuit of FIG. 6.

Figure 6:
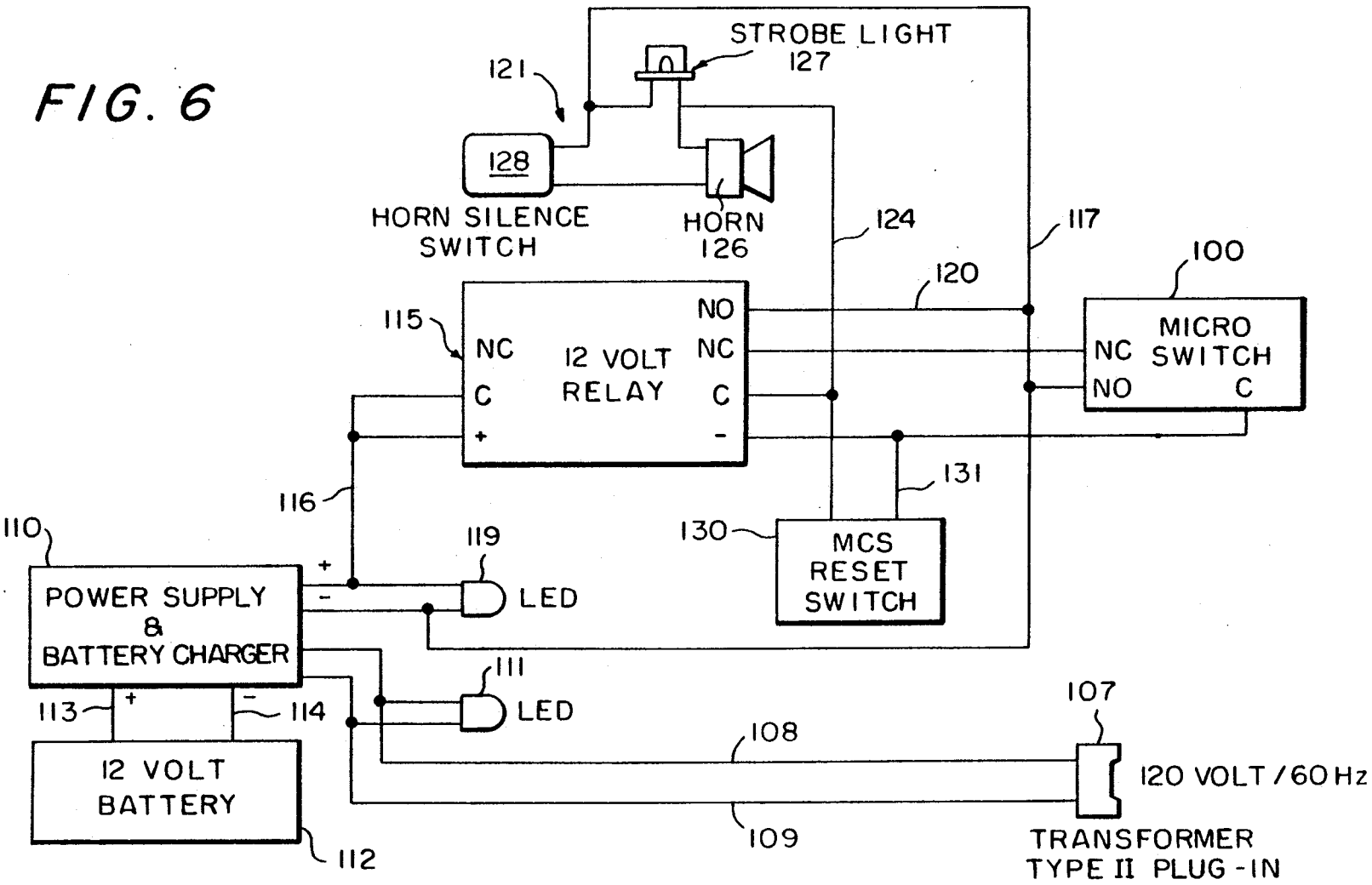
FIG. 6 is a circuit diagram of a control circuit usable with the fire extinguishing system of the instant invention.

The circuit of FIG. 6 is connected to 120-volt/60-hz house current through a plug-in-type transformer 107 which is connected by leads 108 and 109 to a power supply/battery charger 110. An indicator LED 111 indicates that power is flowing through to the power supply and battery charger 110. A 12-volt battery 112 is connected by leads 113 and 114 to the power supply/battery charger and provides 12-volt power to the system in situations wherein the available house current has been interrupted for one reason or another.

The power supply/battery charger 110 has its positive pin connected to a 12-volt relay 115 via line 116 which is connected to both the positive pin on the relay and to one of the closed contacts on the relay. The line 117 from the negative pin of the power supply/battery charger 110 is connected to various other components of the system, while a second LED 119 indicates that the power supply is providing its output. Line 117 is connected to the normally open contact of the 12-volt relay 115 via line 120 and the alarm circuit elements, designated generally by the numeral 121. The microswitch 100 has its closed contact connected to the negative pole of the 12-volt relay and its normally closed contact connected to the normally closed contact on the 12-volt relay. Upon an increase in pressure at the outlet indicative of a discharge of the fire extinguisher 30, the microswitch 100 opens its normally closed contact and closes its normally open contact which causes the 12-volt relay 115 to open its normally closed contact on the negative side and to close its normally open contact on the negative side, while closing its normally open contact on the positive side. This causes 12-volt direct current to flow through lines 117 and 120.

Upon operation of the microswitch 100, the microswitch energizes horn 126 and optional strobe light 127 in the alarm circuit 121 by closing the normally open contact in 12-volt relay 115 so that current flows through line 117 and through line 124 to energize the horn 126 and power the strobe light 127. The horn 126, of course, alerts the household that there is a fire while warning people to leave the house while at the same time identifying the particular source of the fire. The horn silence switch allows one to shut the horn off after the conflagration has ceased.

Reset switch 130 is connected via line 124 to the closed contact of the 12-volt relay and by line 131 to the closed contact of microswitch 100 and negative pin of the 12-volt relay. The reset switch 130 has normally closed contacts which open upon operation of the microswitch 100. In order to reset the system, the open contacts are closed by pressing a button on the reset switch.

After a fire has occurred, it is necessary to recharge or replace the fire extinguisher 30. To facilitate restringing of the cable assembly 35, it is preferable to use reusable links 48, 56, 60, and 69, rather than fused links. In preferred embodiments, the reusable links are calibrated to release at 160° F. for electric stoves and 370° F. for gas stoves; however, the reusable and fusible links may be configured to release at other selected temperatures within that range.

The number of links required is determined by the number of cooking surface elements on the range top. Normally, four links are required and provided with each Guardian unit. However, a maximum of two additional links may be added to the system, provided the minimum separation distances are maintained.

For applications where the maximum ambient temperature exceeds the rating for the 160° F. link used for electric ranges, a higher rated link should be used. A variety of temperature ratings are available, ranging from 160°–370° F., depending on the maximum ambient temperature recorded under the range hood 12.

The use of the low voltage circuit of FIG. 6 eliminates the hard wire and rigid metal conduit necessary with ordinary line current systems and removes the necessity of having to relight the pilot flame on gas supplied stoves. This is accomplished by maintaining electrical energy with power from a back-up battery. Back-up power 112 is available from 1–6 hours.

The circuit of FIG. 6 was fabricated utilizing the following circuit components:

127. Strobe Light (12 Volt DC).
Supplier: Tandy Corporation (Radio Shack) or Amseco, Inc.

126. Horn (4–24 Volt DC), 85 db @10′ or 90 db @10′ or 100 db @10′, dual tone-pulsed or steady.
Supplier: Tandy Corporation (Radio Shack) or Moose Corporation.

128. Horn Silence Switch, general purpose 125V AC/DC 3A one or two pole Toggle Switch with On/Off name plate.
Supplier: Tandy Corporation (Radio Shack) or EATON Cutler-Hammer or other listed switch.

115. Relay, double pole/double throw, Rated 3A @125VAC, 12V Coil and relay socket with retaining clip mounted on circuit board.
Supplier: Tandy Corporation (Radio Shack) or Alarm Controls Corporation or Twenty First Century Int'l Fire & Svcs Corporation or SPC Technology or Potter and Brumfield.

77. Miniature Snap-Action (Micro Switch), Rated 10A @125/250VAC, ¼ Hp, with phenolic case and coil spring mechanism.
Supplier: Cherry Electric Product Corporation or Unimax Switch Corporation.

107. Transformer, Class II type plug-in with 120 Volt 60Hz AC primary, 12 Volt,20VA or 18 Volt,20VA or 18 Volt,35VA with machine screw for securing to 120VAC standard wall receptacle.
Supplier: Moose or other UL Listed having equal specifications.

Miniature Push Button Switch, momentary SPST Contacts (Normally Closed) rated 0.5A @125VAC.
Supplier: Tandy Corporation (Radio Shack) or other having equal specifications.

111. Light-Emitting Diode (LED), green, power dissipation 75 mW, forward current 25 mA, luminous 119. Intensity 6.3 mcd, also, 1K ½ W resister added to Cathode (-minus) lead.
Supplier: Tandy Corporation (Radio Shack) or other having equal specifications.

110. Power Supply and Battery Charger, regulated DC output selectable for 6.9 or 13.8 volts, 4A self-restoring circuit breaker, 1A continuous output wit 0.2 volt ripple. Where less output is required, other power supply and battery charger to be used shall have 3A fused circuit 13.8 VDC at 600 milliamps continuous-output.
Supplier: Moose or other having equal specifications.

112. Battery, 1.2 AH, 12 volt or 4 AH, 12 volt, sealed lead acid rechargeable.
Supplier: Yuasa, Moose, PowerSonic, or other having equal specifications.

Figure 7:
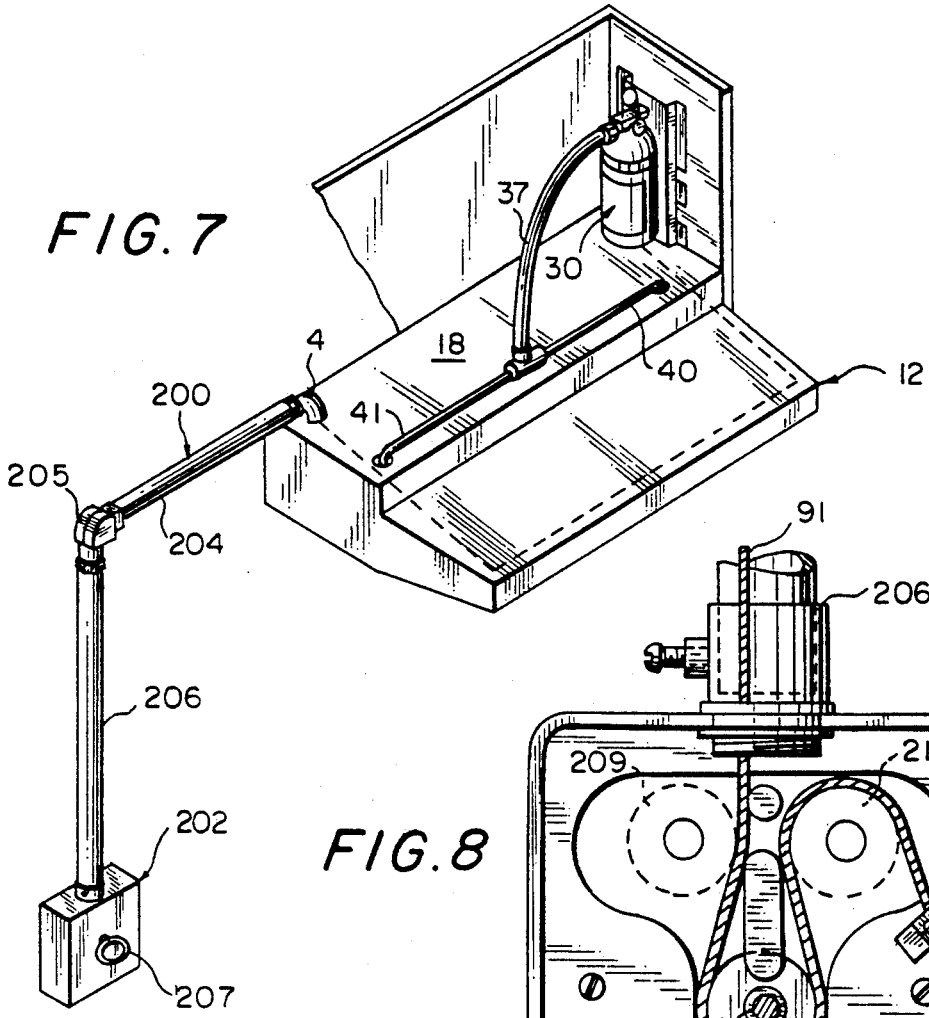
FIG. 7 is a perspective view of a remote release manual pull system according to the instant invention, optionally installable with the aforedescribed system.
Figure 8:
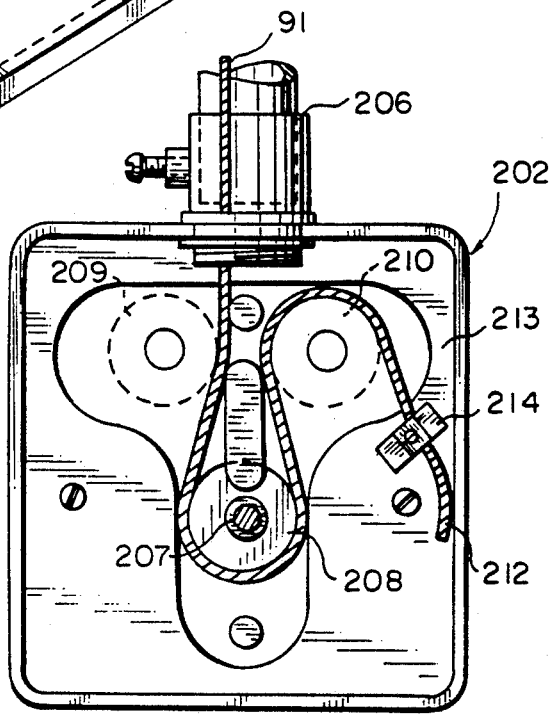
FIG. 8 is a front view of a floating pulley arrangement providing the remote release.

Referring now to FIGS. 7 and 8, there is shown a manual release system, designated generally by the numeral 200, in which the cable 91 of FIG. 1 is attached to a remote manual release assembly, designated generally, by the numeral 202, instead of being anchored by the stop 94, as in FIG. 1. The cable 91 passes around a corner pulley 203, through a ½ conduit 204, around a corner pulley 205, and through a ½ conduit 206 into the manual release assembly 202. Preferably, the length of the cable 91 is no greater than 10'. The manual release assembly 202 retains the cable 91 taut with a pull pin 207. If, for some reason, the cable assembly 35 does not release when a fire occurs, a person near the range 10 can extinguish the fire by pulling pin 207.

As is seen in FIG. 8, the cable 91 is tensioned by a floating pulley 208, which is held displaced from stationary pulleys 209 and 210 by the pin 207, which is received through the center of the floating pulley. The free end 212 of the cable 91 is anchored to the housing 213 of the manual release assembly by a cable nut 214. When the pin 207 is pulled, the floating pulley 208 is released, and the cable slackens, allowing spring 33 (FIG. 2) to pivot the operating lever 33 and thus activate the fire extinguisher 30. By having a remote manual release 202 displaced from the range 10, a manual redundancy is provided, enhancing the effectiveness of the system.

Figure 9:
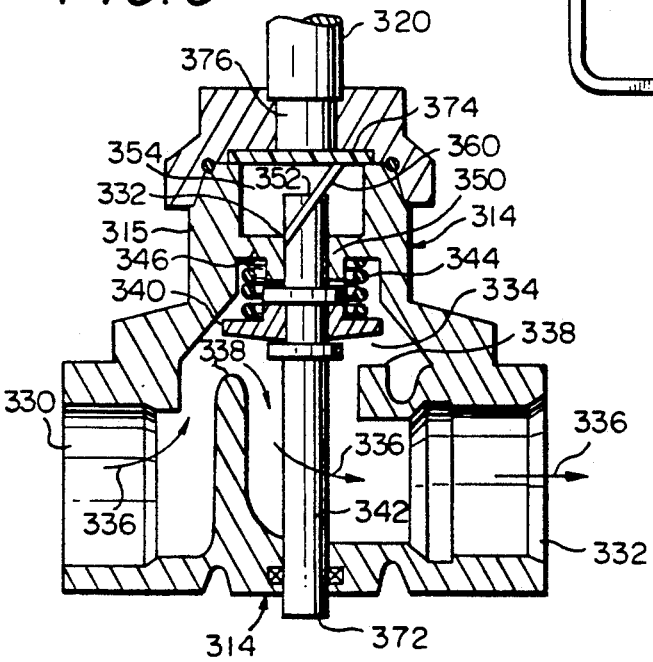
FIG. 9 is an enlarged side elevational view of a valve which may be used to accomplish the purposes of the valve generally shown in FIG. 1.
Figure 10:
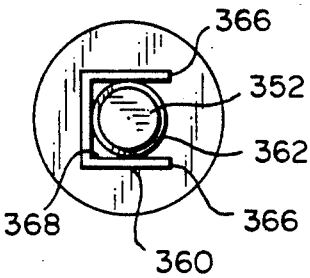
FIG. 10 is a top elevational view of a portion of the valve of FIG. 9.

Referring now again to FIG. 1 in combination with FIG. 9, there is shown the improvement of the instant invention wherein the gas burners 11 are connected by gas lines 302, 304, 306, and 308 to a manifold 310. The manifold 310 is, in turn, connected by line 312 to a pneumatically operated gas control valve, designated generally by the numeral 314. The valve 314 is connected to a household gas supply line 316 through a shut-off valve 318. The valve 314 is connected by a braided hose 20 to a tee 322, which is disposed just upstream of the distribution assembly tee 39. Preferably, the pneumatically operated gas line valve 314 is a valve available from the Fluidex Division of Parker Hannian Corporation, Model No. NB19-014-01 disclosed in U.S. Pat. No. 5,048,791, incorporated herein by reference. While the Parker Hannian Corporation valve is the preferable valve, any valve which is pneumatically operated by an increase in pressure in the line 320 due to discharge of the fire extinguisher 30 is within the purview of the instant invention.

Referring now more specifically to FIG. 9, where a preferred embodiment of the valve 314 is shown in cross section, it is seen that the valve is defined by a housing 315 which has an inlet chamber 330 to which is connected the incoming gas line 316 through the shut-off valve 318 and an outlet chamber 332 to which is attached the flexible piping 312 that is connected through the manifold 310 to the burners 11. The valve 314 includes a chamber 334 connecting the inlet chamber 330 to the outlet chamber 332, which normally allows gas to flow in the direction of arrows 336. The interface between the chamber 334, the inlet chamber 330, and outlet chamber 332 is defined by a valve seat 338. A rubber closure disc 340 is mounted proximate the valve seat 338 to close the valve 314 when pressed against the seat. A coil spring 344 under compression is disposed between the closure disc 340 and a shoulder 346 extending inwardly from the valve housing 315. Inboard of the shoulder 346 is a sleeve 350, which receives the valve stem 342.

The upper end 352 of the valve stem 342 is received in an upper chamber 354. In order to hold the stem against the bias of the spring 344, a U-shaped latching spring 360 is received in a groove 362 disposed in the periphery of the valve stem 352. The latching spring 360 is pivoted with respect to the valve stem 342 so that when the upper ends of the legs 366 of the spring are pushed, the bite 368 of the spring pops out of the groove 362, allowing the valve stem 342 to be urged downwardly by the coil spring 344. This seats the rubber valve closure member 340 against the valve seat 338, immediately stopping the flow 336 of gas through the valve 314.

In order to reset the valve, the valve stem has a projecting portion 372, which projects from the bottom of the valve housing 315 and serves as a reset button which may be manually pressed to again urge the valve stem 342 upwardly against the bias of the spring 344 until the bite 368 of the retaining spring 360 is received in the groove 362.

Disposed above the upper ends of the legs 366 of the spring 360 is a pressure diaphragm 374, one side of which is in communication with a bore 376 to which the hose 320 (FIG. 1) is connected. Upon discharge of the fire extinguisher 30, the line 37 is pressurized, which pressurizes air in the line 320, deflecting the diaphragm 374 against the upper ends 366 of the spring 360.

The aforedescribed valve 314 may be installed in either a horizontal or vertical run of supply piping without affecting its operation. Moreover, for ease of installation, the valve 314 can be installed in any orientation.

In this way, when there is a fire on the stove 10, the flow of gas through the line 316 to the burners 11 of the stove is stopped so that after the fire is extinguished, gas does not continue to flow into the kitchen. The pneumatically operated gas line valve 314, therefore, minimizes the possibility of occupants of the building in which the kitchen is located being asphyxiated by gas, as well as minimizing the possibility of a gas explosion due to unburned gas flowing into a kitchen containing the stove.

The entire disclosures of all applications, patents, and publications, cited herein, are hereby incorporated by reference.

From the foregoing description, one skilled in the art can easily ascertain the essential characteristics of this invention and, without departing from the spirit and scope thereof, can make various changes and modifications of the invention to adapt it to various usages and conditions.

What is claimed is:

1. In a combination, a residential cookstove with gas burners, a gas supply line connected to the gas burners and a fire extinguisher system including a fire extinguisher containing a pressurized fire extinguishing material, means for sensing a fire occurring on the residential cookstove and means for initiating discharge of the fire extinguisher upon detection of the fire, the fire extinguishing system further comprising a pneumatically operated valve disposed between the gas supply line and the gas burners, the pneumatically operated valve being connected directly to the outlet of the fire extinguisher and having means associated therewith for closing the valve upon discharging the fire extinguisher.

2. The combination of claim 1, further including a hood over the cookstove with the means for sensing fire being disposed within the hood.

3. The combination of claim 2, further including a cabinet disposed above the hood with the fire extinguisher in the cabinet, the fire extinguisher having a tubular distribution system connected thereto for dispensing the fire suppressing material toward the stove with the pneumatically operated valve being connected by a tubular member directly to the tubular distribution system.

* * * * *